US011378318B2

(12) United States Patent
Picouet

(10) Patent No.: US 11,378,318 B2
(45) Date of Patent: Jul. 5, 2022

(54) CASCADE SYSTEM FOR USE IN ECONOMIZER COMPRESSOR AND RELATED METHODS

(71) Applicant: Vilter Manufacturing LLC, Cudahy, WI (US)

(72) Inventor: Jean-Louis Picouet, Waukesha, WI (US)

(73) Assignee: Vilter Manufacturing LLC, Cudahy, WI (US)

( * ) Notice: Subject to any disclaimer, the term of this patent is extended or adjusted under 35 U.S.C. 154(b) by 663 days.

(21) Appl. No.: 15/913,637

(22) Filed: Mar. 6, 2018

(65) Prior Publication Data

US 2019/0277551 A1 Sep. 12, 2019

(51) Int. Cl.

| | |
|---|---|
| ***F25B 49/02*** | (2006.01) |
| ***F25B 6/02*** | (2006.01) |
| ***F25B 7/00*** | (2006.01) |
| ***F25B 39/04*** | (2006.01) |
| ***F25B 9/00*** | (2006.01) |
| ***F25B 1/10*** | (2006.01) |

(52) U.S. Cl.

CPC ..... *F25B 49/027* (2013.01); *F25B 1/10* (2013.01); *F25B 6/02* (2013.01); *F25B 7/00* (2013.01); *F25B 9/008* (2013.01); *F25B 39/04* (2013.01); *F25B 2339/0444* (2013.01); *F25B 2400/13* (2013.01); *F25B 2400/16* (2013.01); *F25B 2400/23* (2013.01)

(58) Field of Classification Search

CPC .... F25B 1/10; F25B 9/008; F25B 7/00; F25B 6/02; F25B 49/027; F25B 39/04; F25B 2339/0444; F25B 2400/23; F25B 2400/13; F25B 2400/16

See application file for complete search history.

(56) References Cited

U.S. PATENT DOCUMENTS

| | | | | |
|---|---|---|---|---|
| 4,313,309 | A * | 2/1982 | Lehman, Jr. | F25B 7/00 62/175 |
| 5,740,679 | A * | 4/1998 | Ueno | F25B 7/00 62/175 |
| 6,405,554 | B1 * | 6/2002 | Kawakatu | F25B 7/00 62/335 |
| 6,519,967 | B1 | 2/2003 | Mosemann et al. | |
| 7,065,979 | B2 | 6/2006 | Arshansky et al. | |

(Continued)

FOREIGN PATENT DOCUMENTS

| | | |
|---|---|---|
| CN | 103968455 | 2/2017 |
| WO | 96/21830 | 7/1996 |

OTHER PUBLICATIONS

PCT/US2019/020738 International Search Report and Written Opinion of the International Searching Authority dated May 29, 2019 (14 pages).

*Primary Examiner* — Joseph F Trpisovsky
(74) *Attorney, Agent, or Firm* — SmithAmundsen LLC

(57) ABSTRACT

A refrigeration apparatus comprises a first refrigerant system and a second refrigerant system. The first refrigerant system comprises a first compressor, a cascade heat exchanger and a first evaporator. The second refrigerant system comprises a second compressor, a second condenser, the cascade heat exchanger and a second evaporator. The second compressor has an economizer port, and the cascade heat exchanger is connected to the economizer port of the second compressor.

14 Claims, 3 Drawing Sheets

(56) References Cited

U.S. PATENT DOCUMENTS

| | | | | |
|---|---|---|---|---|
| 7,406,837 | B2 | 8/2008 | Nemoto et al. | |
| 2001/0023594 | A1* | 9/2001 | Ives | F25B 9/008 62/335 |
| 2003/0024262 | A1* | 2/2003 | Mosemann | F25B 1/047 62/335 |
| 2007/0056312 | A1 | 3/2007 | Kobayashi | |
| 2009/0260389 | A1 | 10/2009 | Dube | |
| 2010/0147006 | A1 | 6/2010 | Taras et al. | |
| 2011/0061419 | A1* | 3/2011 | Martin | F25B 25/005 62/335 |
| 2011/0072836 | A1* | 3/2011 | Wang | F25B 49/022 62/79 |
| 2011/0094259 | A1 | 4/2011 | Lifson et al. | |
| 2013/0091891 | A1 | 4/2013 | Hinde et al. | |
| 2015/0153076 | A1 | 6/2015 | Sugimoto et al. | |
| 2015/0153086 | A1* | 6/2015 | Takayama | F25B 5/04 62/228.3 |
| 2015/0226464 | A1 | 8/2015 | Kontomaris | |
| 2015/0285539 | A1* | 10/2015 | Kopko | F25B 5/02 62/115 |
| 2016/0363356 | A1 | 12/2016 | Hinde et al. | |

* cited by examiner

Prior Art

CASCADE SYSTEM FOR USE IN ECONOMIZER COMPRESSOR AND RELATED METHODS

FIELD OF THE INVENTION

The present invention relates generally to cooling and/or refrigeration systems, and more particularly to a cascade system for use in an economizer compressor for cooling and/or refrigeration systems.

BACKGROUND OF THE INVENTION

Traditional cascade refrigeration systems use two kinds of refrigerant and generally are composed of a first refrigerant system using a first refrigerant and a second refrigerant system using a second refrigerant. The first refrigerant system is typically a low temperature system and operates with the first type of refrigerant. The second refrigerant system is typically a high temperature system and operates with the second type of refrigerant. The two refrigerant systems operate independently in the cascade refrigeration system with a cascade heat exchanger situated between the two refrigerant systems. At a high level, the high temperature refrigerant system is used to cool the condenser of the low temperature refrigerant system by way of the cascade heat exchanger.

The two refrigerant systems of a cascade refrigeration system are generally not located adjacent one another. In many instances, one of the refrigerant systems (usually the low temperature system) is located at a location distant (remote) from the area that is being cooled, such as on the roof of a building, while the other of the refrigerant systems is located near the area that is being cooled, such as in an engine room. The cascade heat exchanger is therefore located in the same vicinity as the remote refrigerant system. In instances in which the remote refrigerant system and cascade heat exchanger are located on a rooftop, it will be appreciated that the resulting system has a large rooftop footprint and the rooftop must therefore hold a significant amount of weight.

Integrating a cascade system with an existing single-system (non-cascade) refrigeration system can be difficult. When retro-fitting an existing refrigeration system with a second refrigerant system in a cascade arrangement, refrigerant from the cascade heat exchanger is sent to the suction side of the compressor of the existing system. While the cascade system, as a whole, improves the efficiency of the refrigeration system, the capacity of the existing compressor is lowered and the existing compressor uses more horsepower. For example, FIG. 1 shows such an exemplary refrigeration system.

FIG. 1 is a process flow schematic of a prior art refrigeration system 1 using a cascade heat exchanger 2. The refrigeration system 1 has a first refrigerant system 1*a* and a second refrigerant system 1*b*.

Refrigerant in the first refrigerant system 1*a* is pulled from the evaporator 3*a* into the compressor 4*a* at the suction side of the compressor 4*a*. The gaseous refrigerant is compressed and discharged to the cascade heat exchanger 2. From the cascade heat exchanger 2, the liquid refrigerant is collected in a liquid receiver 6*a* and passed through a first expansion valve 8*a* where it is turned into a liquid/vapor mix before re-entering the evaporator 3*a*.

In some embodiments, the first refrigerant system 1*a* may also include a condenser and/or one or more secondary refrigerant loops which bypass the cascade heat exchanger 2 so as, for example, to adjust the pressure and/or temperature experienced by the cascade heat exchanger.

Refrigerant from the second refrigerant system 1*b* is pulled from the evaporator 3*b* into the suction side of the compressor 4*b*. As shown in FIG. 1, an additional portion of the second refrigerant from the cascade heat exchanger 2 enters the compressor 4*b* at the suction side of the compressor 4*b*. It will be appreciated that the additional portion of the second refrigerant therefore consumes some of the volume of the compressor which would otherwise be occupied by second refrigerant from the evaporator 3*b*. The second refrigerant is compressed in the compressor 4*b* and discharged to the condenser 5. In the condenser 5, the compressed gas is cooled and condensed to a liquid which is temporarily stored in the liquid receiver 6*b*. The liquid receiver has two outlets 7*a* and 7*b*, with the first outlet 7*a* moving a first (majority) portion of the liquid refrigerant to a first expansion valve $\mathbf{8}b_1$ before it re-enters the evaporator 3*b*. The second outlet 7*b* moves a second (minor) amount of liquid refrigerant to a second expansion valve $\mathbf{8}b_2$, and then to the cascade heat exchanger 2 and re-enters the compressor 4*b* at the suction side of the compressor 4*b*.

It would be desirable to provide a cascade refrigeration system which addresses one or more of the drawbacks associated with the system shown in FIG. 1.

SUMMARY OF THE INVENTION

In accordance with at least one aspect of the invention, a refrigeration apparatus is provided. The refrigeration apparatus comprises a first refrigerant system comprising a first compressor, a cascade heat exchanger, and a first evaporator; and a second refrigerant system comprising a second compressor, a second condenser, the cascade heat exchanger, and a second evaporator, wherein the second compressor comprises an economizer port and the cascade heat exchanger is connected to the economizer port.

In accordance with at least a further aspect of the invention, a refrigeration apparatus is provided. The refrigeration apparatus comprises a first refrigerant system comprising a first compressor, a cascade heat exchanger, and a first evaporator, wherein the first compressor is connected to the cascade heat exchanger, the cascade heat exchanger is further connected to the first evaporator, and the first evaporator is further connected to the first compressor; and a second refrigerant system comprising a second compressor having a suction side inlet and an economizer port inlet, a second condenser, the cascade heat exchanger, and a second evaporator, wherein the second compressor is connected to the second condenser, the second condenser is further connected to the cascade heat exchanger and the second evaporator, the second evaporator is further connected to the second compressor at the suction side inlet, and the cascade heat exchanger is further connected to the second compressor at the economizer port inlet.

In accordance with at least a further aspect of the invention, a method of providing a cooling effect is provided. The method comprises passing a first portion of a first refrigerant through a condenser side of a cascade heat exchanger; and passing a first portion of a second refrigerant through an evaporation side of the cascade heat exchanger and into an economizer port of a compressor.

Various other aspects, objects, features and embodiments of the invention are disclosed with reference to the following specification, including the drawings.

Notwithstanding the above examples, the present invention is intended to encompass a variety of other embodiments including for example other embodiments as are described in further detail below as well as other embodiments that are within the scope of the claims set forth herein.

BRIEF DESCRIPTION OF THE DRAWINGS

Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. Like reference numerals are used to indicate like components. In the drawings.

DETAILED DESCRIPTION

Figure 2:
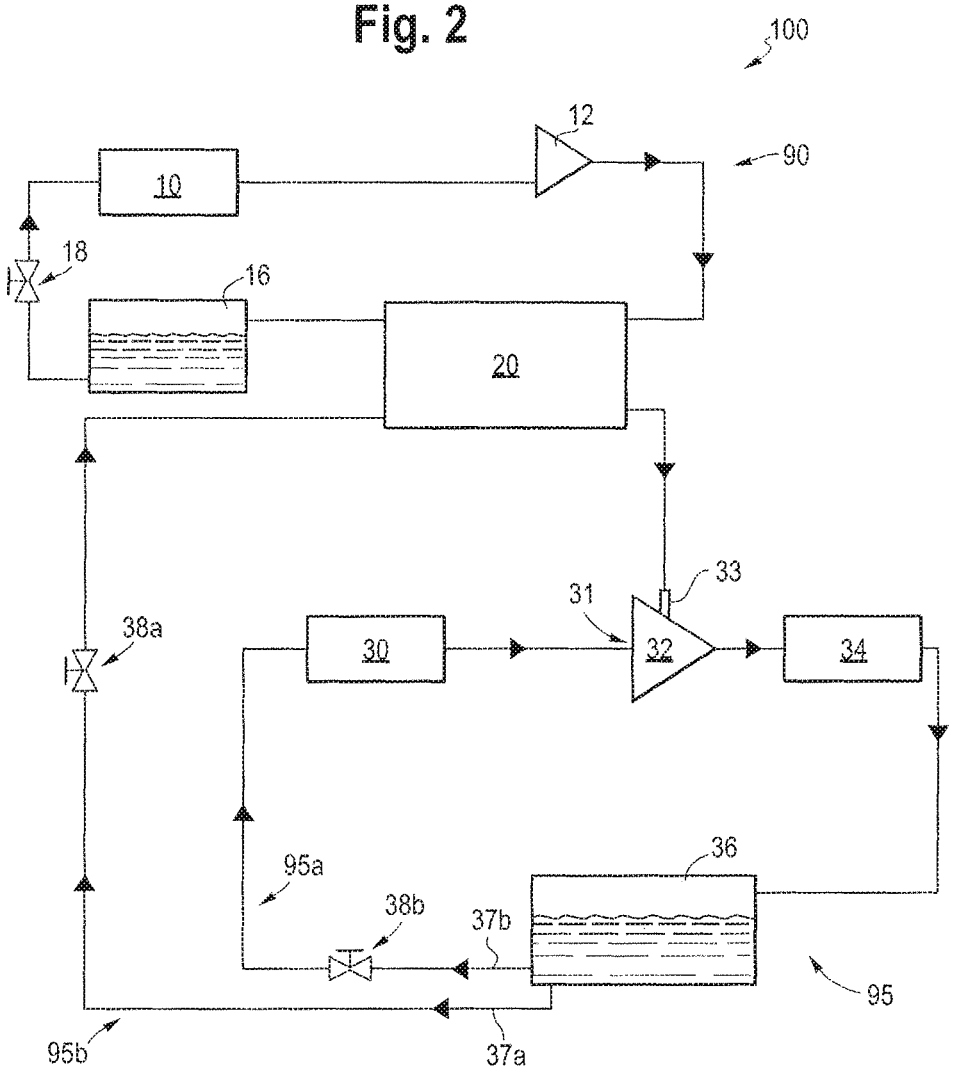
FIG. 2 is a process flow schematic of an exemplary refrigeration system in accordance with embodiments of the present disclosure.

FIG. 2 is a process flow schematic of a refrigeration system 100 in accordance with embodiments of the present disclosure.

In the embodiment shown, the refrigeration system 100 is a cascade system having a first refrigerant system 90 and a second refrigerant system 95 with an economizer circuit 95*b*.

In the embodiment shown, the first refrigerant system 90 is a subcritical $CO_2$ system and the second refrigerant system 95 is a high pressure refrigeration system.

The first refrigerant system 90 comprises a first evaporator 10, a first compressor 12, and the cascade heat exchanger 20 in a single refrigerant loop. In an embodiment, the first evaporator 10 is connected to the first compressor 12, the first compressor 12 is further connected to the cascade heat exchanger 20, and the cascade heat exchanger 20 is further connected to the first evaporator 10.

In an embodiment, a first refrigerant system 90 may include additional first evaporators 10 and/or first compressors 12.

In an embodiment, the first refrigerant system 90 may additionally include one or more liquid receivers, tanks, expansion valves and/or fans.

As used herein, the term "connected" and similar terms and phrases means operably coupled with, whether directly or indirectly with one or more intervening structures or assemblies.

The first evaporator 10 is connected to the first compressor 12. In the embodiment shown in FIG. 2, the first evaporator 10 directly connected to the first compressor 12.

The first compressor 12 is connected to the cascade heat exchanger 20. In an embodiment, such as shown in FIG. 2, the first compressor 12 is directly connected to the cascade heat exchanger 20. In an embodiment, the first compressor 12 is directly connected to both the first evaporator 10 and cascade heat exchanger 20.

The cascade heat exchanger 20 is further connected to the first evaporator. In an embodiment, the cascade heat exchanger 20 is indirectly connected to the first evaporator 10. In the embodiment shown in FIG. 2, the cascade heat exchanger 20 is indirectly connected to the first evaporator 10 by way of an expansion valve 18 and/or a liquid receiver 16.

As shown in FIG. 2, the second refrigerant system 95 comprises a second evaporator 30, a second compressor 32 having a suction side inlet 31 and an economizer port 33, a condenser 34, and the cascade heat exchanger 20.

In an embodiment, the second evaporator 30 is connected to the second compressor 32 at the suction side inlet 31 and the cascade heat exchanger 20 is connected to the second compressor 32 at the economizer port 33, the second compressor 32 is further connected to the condenser 34, and the condenser 34 is further connected to the cascade heat exchanger 20.

In other words, in the embodiment shown, the second refrigerant system 95 includes a primary second refrigerant loop 95*a* which cycles refrigerant from the second compressor 32 to the condenser 34, to the second evaporator 30, and back to the second compressor 32, and a secondary refrigerant loop (or economizer circuit) 95*b* which cycles refrigerant from the second compressor 32 to the condenser 34, to the cascade heat exchanger 20, and back to the second compressor 32. As used herein, the term "connected" and similar terms and phrases means operably coupled with, whether directly or indirectly with one or more intervening structures or assemblies.

In further embodiments, the second refrigerant system 95 may additionally include one or more liquid receivers, tanks, expansion valves and/or fans.

The second evaporator 30 is connected to the second compressor 32. In an embodiment, the second evaporator 30 is directly connected to the second compressor 32 at the suction side inlet 31.

The cascade heat exchanger 20 is also connected to the second compressor 32. In the embodiment shown in FIG. 2, the cascade heat exchanger 20 is directly connected to the second compressor 32 at the economizer port 33. In a further embodiment, the cascade heat exchanger 20 is indirectly connected to the second compressor 32 at the economizer port 33.

The second compressor 32 is also connected to the condenser 34. In an embodiment, the second compressor 32 is directly connected to the condenser 34. In an embodiment, the second compressor 32 is directly connected to both the second evaporator 30 and condenser 34.

The condenser 34 is connected to the cascade heat exchanger 20. In an embodiment, the condenser 34 is indirectly connected to the cascade heat exchanger 20. In the particular embodiment shown in FIG. 2, the condenser 34 is indirectly connected to the cascade heat exchanger 20 by way of a liquid receiver 36 and an expansion valve 38*a*.

The condenser 34 is also connected to the second evaporator 30. In an embodiment, the condenser 34 is indirectly connected to the second evaporator 30. More particularly, as shown in FIG. 2, the condenser 34 is indirectly connected to the second evaporator 30 by way of a liquid receiver 36 and expansion valve 38*b*.

In an embodiment, the first refrigerant system 90 includes a first refrigerant. In an embodiment, the first refrigerant is carbon dioxide ($CO_2$).

In an embodiment, the second refrigerant system 95 includes a second refrigerant. In an embodiment, the second refrigerant is selected from ammonia ($NH_3$), hydrofluorocarbons (HFCs), and combinations thereof.

The passage of first and second refrigerants through the first refrigerant system 90 and second refrigerant system 95, respectively, is now described.

In the embodiment shown in FIG. 2, in the first refrigerant system 90, gaseous refrigerant, e.g., $CO_2$, from the first evaporator 10 is pulled into the compressor 12, compressed, and discharged to the cascade heat exchanger 20. The liquid refrigerant is then temporarily stored in the liquid receiver 16 and passed through an expansion valve 18 before re-entering the evaporator 10.

In the second refrigerant system 95 (shown in FIG. 2), refrigerant gas, e.g., ammonia ($NH_3$), from the evaporator 30 is pulled into the compressor 32. The compressor 32 includes an economizer port 33. After a given compression chamber has been sealed for compression and, in some embodiments, at least partially compressed, an additional portion of refrigerant from the cascade heat exchanger 20 is added to the chamber via the economizer port 33.

Figure 1:
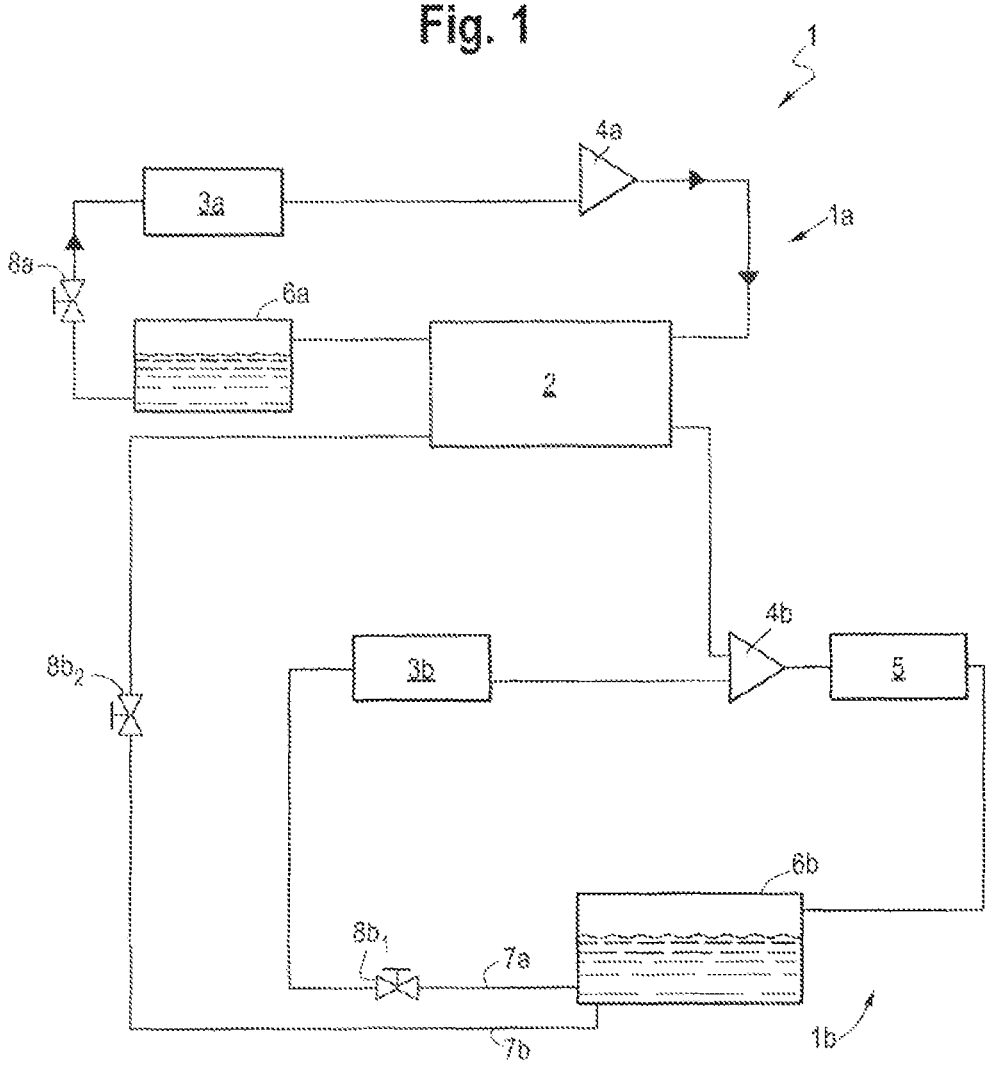
FIG. 1 is a process flow schematic of an existing refrigeration system incorporating a cascade heat exchanger.

It will be appreciated that the portion of the second refrigerant added to the compressor 32 via the economizer port 33 is in an at least partially compressed state. The volume of refrigerant in the chamber is therefore increased relative to a refrigerant system which does not introduce refrigerant to a compressor via an economizer port, and the overall efficiency of the compressor 32 is improved. In an embodiment, the efficiency of the refrigerant system 95, as a whole, is approximately 10-20% improved relative to a refrigerant system having just a "second refrigerant system" 95 as described herein or a refrigerant system in which all the second refrigerant is introduced to the second compressor 32 via the suction side 31 of the compressor, such as shown in FIG. 1.

The second refrigerant (comprising a main gaseous portion from the evaporator and a minor portion from the cascade heat exchanger 20) is compressed and discharged to the condenser 34. In the condenser 34, the compressed gas is cooled and condensed to a liquid which is temporarily stored in the liquid receiver 36. The liquid receiver 36 has two outlets 37*a*, 37*b*, with a first outlet 37*a* moving a first portion of the condensed and cooled liquid refrigerant through a first expansion valve 38*a* where it is turned into a liquid/vapor mix before entering the cascade heat exchanger 20. A second outlet 37*b* moves a second portion of the condensed and cooled liquid refrigerant to a second expansion valve 38*b* where it is turned into a liquid/vapor mix before re-entering the evaporator 30. In an embodiment, the first portion of the condensed and cooled liquid refrigerant is less than the second portion of the condensed and cooled liquid refrigerant. The first portion of the condensed and cooled liquid refrigerant may therefore be referred to as a minor amount, while the second portion of the condensed and cooled liquid refrigerant may be referred to as a majority amount.

It will be appreciated that the cascade heat exchanger 20 operates as a condenser for the first refrigerant system 90 and as an evaporator for the second refrigerant system 95. Refrigerant from the first refrigerant system 90 is condensed by the cascade heat exchanger 20 with the refrigerant of the second refrigerant system 95 evaporating and being drawn off.

In the embodiment shown, the first refrigerant system 90 has suction temperature from −50° F. to −30° F. and a condensing temperature from 15° F. to 25° F.

In the embodiment shown, the second refrigerant system 95 has a suction temperature from −20° F. to 0° F. and a condensing temperature from 95° F. to 120° F.

In the embodiment shown, the second refrigerant system 95 has an economizer temperature range from 15° F. to 25° F. to match the condensing temperature of the first refrigerant system 90.

In an embodiment, the first refrigerant is $CO_2$ and the first refrigerant system 90 is a subcritical $CO_2$ system.

In an embodiment, the second refrigerant is ammonia ($NH_3$) and the second refrigerant system 95 is a high pressure refrigeration system.

Figure 3:
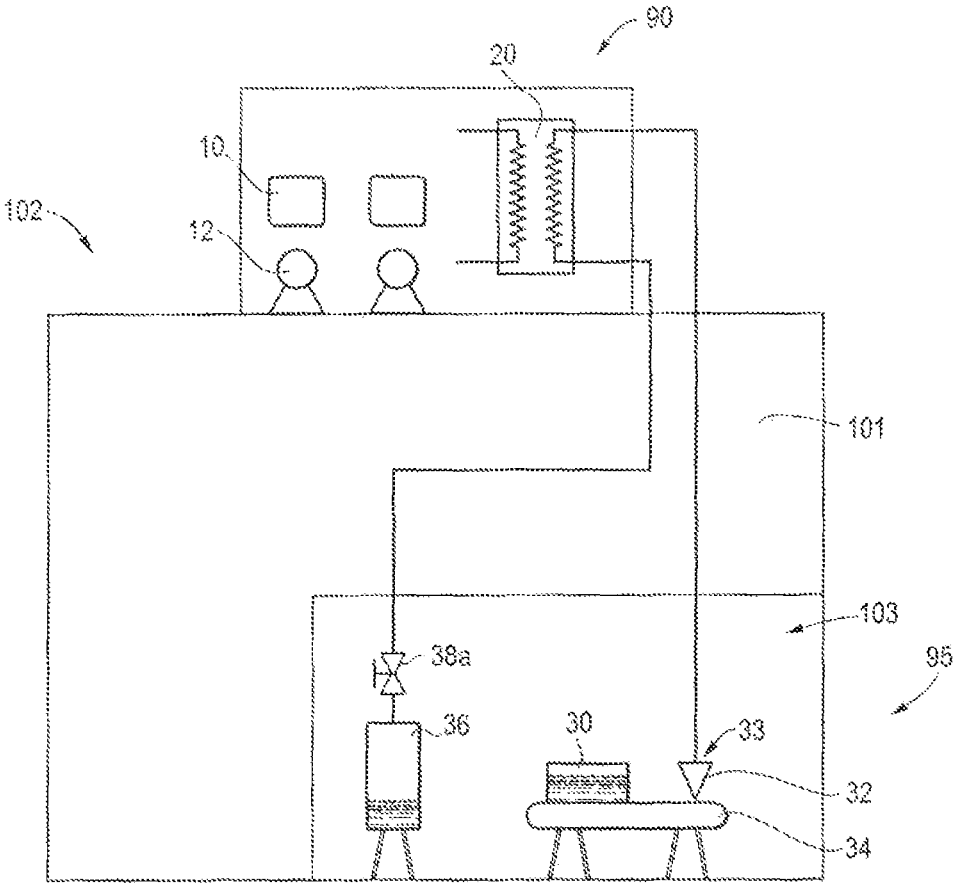
FIG. 3 is a schematic of the exemplary refrigeration system of FIG. 2 in accordance with embodiments of the present disclosure.

FIG. 3 is a schematic of the exemplary refrigeration system of FIG. 2, although not all of the system components shown in FIG. 2 and shown in FIG. 3. As shown in FIG. 3, all or a portion of the first refrigerant system 90 may be provided at any suitable location such as on the roof 102 of a facility or other suitable location. The first refrigerant system 90 is operated and controlled in a conventional manner to provide a desired amount of cooling to the cold storage and the second refrigerant system 95 also provides the desired condensing pressure and temperature to the cascade heat exchanger 20 in order to control the pressure of the first refrigerant system 90 using the economizer port 33.

In the particular embodiment shown in FIG. 3, the first refrigerant system 90 is provided on a rooftop 102 of a building 101 with the second refrigerant system 95 in an existing engine room 103 of the building 101. While in the embodiment shown the cascade heat exchanger 20 is located on the rooftop 102, it will be appreciated that the cascade heat exchanger 20 may be located in the building 101 or, more particularly, in the engine room 103, depending on the design of the refrigeration system 100.

By utilizing a cascade refrigeration system as shown and described, the system 100 is more efficient and less expensive than conventional cascade systems. Moreover, only the subcritical $CO_2$ unit need be located on a roof or other elevated location. The rooftop weight and footprint are therefore reduced.

For example, refrigerant systems consistent with the second refrigerant systems 95 disclosed herein take up a large area and are generally around 100-500 tons or more. In contrast, refrigerant systems consistent with the first refrigerant systems 90 disclosed herein take up a much smaller area and are generally around 30-60 tons. The present system 100 is therefore advantageous to increase cooling capabilities of refrigerant systems when space near the site to be cooled is limited and/or the weight capacity of a rooftop is limited. Similarly, when looking to increase the cooling capabilities of existing refrigerant systems, it may not be easy or practical to modify or add to the existing refrigerant system (e.g., there is not enough room in an engine room). Retrofitting existing refrigerant systems ("second refrigerant systems" 95) with a first refrigerant system 90 as disclosed herein will increase the cooling capabilities of the existing refrigerant systems without requiring significant modification to the existing refrigerant system and/or its existing location (e.g., the first refrigerant system 90 may, in some instances, be small enough to install local to the existing refrigerant system and/or of low enough weight to be installed on a rooftop or some other remote location otherwise unable to support the existing refrigerant system).

In an embodiment, a method of providing a cooling effect is provided.

In an embodiment, the method of providing a cooling effect includes passing a first portion of a first coolant through a condenser side of a cascade heat exchanger, and passing a first portion of a second coolant through an evaporation side of a cascade heat exchanger and into an economizer port of a compressor.

In an embodiment, the method of providing a cooling effect further includes passing the first portion of the first coolant through a first evaporator and a first compressor before passing the first portion of the first coolant through the condenser side of the cascade heat exchanger.

In an embodiment, the method further includes passing the first portion of the second coolant through a second compressor and a second condenser before passing the first portion of the second coolant through the evaporator side of the cascade heat exchanger.

In an embodiment, the method includes providing a first refrigerant system comprising the first evaporator, the first compressor, and the cascade heat exchanger, as described according to any one or more embodiments herein.

In an embodiment, the method includes providing a second refrigerant system comprising the second compressor and second condenser, as described according to any one or more embodiments herein.

In an embodiment, the first refrigerant system further includes at least one of a condenser, an expansion valve and a first liquid receiver. In an embodiment, the method further includes passing the first portion of the first refrigerant through the first evaporator, first compressor, a first condenser, the condenser side of the cascade heat exchanger, a first liquid receiver, and an expansion valve, and returning the at least a first portion of the first refrigerant to the first evaporator.

In an embodiment, the method further includes passing a second portion of the first refrigerant through the first evaporator and first compressor and returning the second portion of the first refrigerant to the first evaporator. In an embodiment, the process includes passing the second portion of the first refrigerant through the first evaporator, first compressor, first condenser, and an expansion valve before returning the second portion of the first refrigerant to the first evaporator.

In an embodiment, the second refrigerant system further includes at least one of an expansion valve, a second liquid receiver, and an economizer tank. In an embodiment, the method further includes passing the first portion of the second refrigerant through the second compressor, the second condenser, the second liquid receiver, the economizer tank, an expansion valve, the evaporator side of the cascade heat exchanger and the economizer port of the second compressor.

In an embodiment, the method further includes passing a second portion of the second refrigerant through the second evaporator, the second compressor and the second condenser before returning the second portion of the second refrigerant to the second evaporator. In an embodiment, the process includes passing the second portion of the second refrigerant through the second evaporator, the second compressor, the second condenser, a second liquid receiver, and an expansion valve before returning the second portion of the second refrigerant to the second evaporator.

It is specifically intended that the present invention not be limited to the embodiments and illustrations contained herein, but include modified forms of those embodiments including portions of the embodiments and combinations of elements of different embodiments as come within the scope of the following claims.

I claim:

1. A refrigeration apparatus comprising:

a first refrigerant system comprising a first compressor, a cascade heat exchanger operates as a first condenser for the first refrigerant system, and a first evaporator, wherein the first compressor is connected to the cascade heat exchanger, the cascade heat exchanger is further connected to the first evaporator, and the first evaporator is further connected to the first compressor; and a second refrigerant system comprising a second compressor, a second condenser, the cascade heat exchanger, and a second evaporator;

wherein the cascade heat exchanger operates as another evaporator for the second refrigerant system; and wherein the second compressor comprises an economizer port and the cascade heat exchanger is directly connected to the economizer port, the second evaporator is directly connected to the second compressor, the second compressor is further connected to the second condenser, and the second condenser is connected to the cascade heat exchanger and the second evaporator.

2. The apparatus of claim 1 further comprising a first refrigerant in the first refrigerant system, wherein the first refrigerant is carbon dioxide.

3. The apparatus of claim 1 further comprising a second refrigerant in the second refrigerant system, the second refrigerant being selected from ammonia, HFCs, and combinations thereof.

4. The apparatus of claim 1, wherein the first refrigerant system and second refrigerant system each further include at least one expansion valve.

5. The apparatus of claim 1, wherein the second compressor comprises a suction side inlet and the second evaporator is directly connected to the suction side inlet.

6. The apparatus of claim 1, wherein the first refrigerant system is configured to be located on a rooftop of a building and the second refrigerant system is configured to be located in the building.

7. The apparatus of claim 6, wherein the cascade heat exchanger is configured to be located on the rooftop.

8. A refrigeration apparatus comprising:

a first refrigerant system comprising a first compressor, a cascade heat exchanger that operates as a first condenser for the first refrigerant system, and a first evaporator, wherein the first compressor is connected to the cascade heat exchanger, the cascade heat exchanger is further connected to the first evaporator, and the first evaporator is further connected to the first compressor; and a second refrigerant system comprising a second compressor having a suction side inlet and an economizer port inlet, a second condenser, the cascade heat exchanger, and a second evaporator, wherein the second compressor is connected to the second condenser, the second condenser is further connected to the cascade heat exchanger and the second evaporator, the second evaporator is further directly connected to the second compressor at the suction side inlet, and the cascade heat exchanger is further directly connected to the second compressor at the economizer port inlet;

wherein the cascade heat exchanger operates as another evaporator for the second refrigerant system; and wherein the first compressor, cascade heat exchanger and first evaporator are located at a first location and the second compressor, second condenser and second evaporator are located at a second location.

9. The apparatus of claim 8 further comprising a first refrigerant in the first refrigerant system is carbon dioxide.

10. The apparatus of claim 9 further comprising a second refrigerant in the second refrigerant system, the second refrigerant being selected from ammonia, HFCs, and combinations thereof.

11. The apparatus of claim 10, wherein the first refrigerant system further includes at least one expansion valve.

12. The apparatus of claim 11, wherein the second refrigerant system further includes at least one expansion valve.

13. The apparatus of claim 12, wherein the first refrigerant system is configured to be located on a rooftop and the second refrigerant system is configured to be located in a building.

14. The apparatus of claim 13, wherein the cascade heat exchanger is configured to be located on the rooftop.

* * * * *